United States Patent [19]

Chamberlain et al.

[11] 4,438,756

[45] Mar. 27, 1984

[54] APPARATUS AND METHOD FOR ACCOMPLISHING EFFICIENT BURNING OF BIOMASS FUEL MATERIALS

[75] Inventors: Joseph G. Chamberlain, 12350 SW. 124th, Tigard, Oreg. 97223; Paul E. Tiegs, Beaverton, Oreg.

[73] Assignee: Joseph G. Chamberlain, Tigard, Oreg.

[21] Appl. No.: 449,461

[22] Filed: Dec. 13, 1982

[51] Int. Cl.[3] ..... F24B 7/00

[52] U.S. Cl. ..... 126/131; 110/254; 110/204

[58] Field of Search ..... 126/110, 117, 79, 84, 126/121, 123, 131; 110/248, 254, 203–205, 210, 214

[56] References Cited

U.S. PATENT DOCUMENTS

| | | | |
|---|---|---|---|
| 1,699,443 | 1/1929 | Owen | 110/205 |
| 1,729,763 | 10/1929 | DeFlorez | 110/205 |
| 2,845,882 | 8/1958 | Bratton | 110/204 |
| 4,061,189 | 12/1977 | Moncrieff-Yeates | 126/131 |
| 4,182,274 | 1/1980 | Williams | 110/204 |
| 4,242,972 | 1/1981 | Sicard | 110/234 |
| 4,330,503 | 5/1982 | Allaire et al. | 110/203 |

*Primary Examiner*—Henry C. Yuen

*Attorney, Agent, or Firm*—Klarquist, Sparkman, Campbell, Leigh & Whinston

[57] ABSTRACT

An apparatus and method accomplishes the burning of biomass fuel materials with up to 80 percent efficiency. The inventive method and apparatus utilize a catalytic converter in communication with a combustion chamber to combust more completely combustion product gases to eliminate hydrocarbon pollutants and produce carbon dioxide gas. The catalytic converter is included within a passageway originating from and terminating in the combustion chamber so that the carbon dioxide gas is directed into the combustion chamber to control the rate of combustion therein. A heat exchanger in communication with the combustion chamber converts for use the heat carried by the carbon dioxide gas.

5 Claims, 7 Drawing Figures

APPARATUS AND METHOD FOR ACCOMPLISHING EFFICIENT BURNING OF BIOMASS FUEL MATERIALS

BACKGROUND OF THE INVENTION

1. Field of the Invention

This invention relates to means for accomplishing the efficient burning of biomass fuel materials, and more particularly, an apparatus and a method which make use of a catalytic converter for conditioning recirculated combustion product gases to eliminate pollutants while maintaining high operating temperatures at low rates of fuel consumption.

2. Description of Related Prior Art

Heating apparatus which burn biomass fuel materials have been known heretofore to include means for promoting increased combustion efficiency. Such heating devices can be classified into two general categories, the first category including apparatus using exhaust gas recirculation techniques and the second category including apparatus equipped with some type of secondary combustion chamber.

References relating to heating apparatus included in the first category disclose heating systems in which combustion gases are recirculated back to the firebox or combustion chamber so as to increase the temperature thereof and facilitate a more complete combustion of the unburned hydrocarbon pollutants.

In particular, U.S. Pat. No. 825,747 of Moldenhauer, et al. discloses a heating stove embodying the general concept of recirculating exhaust gases back to the combustion chamber and beneath the grate supporting the combustible fuel material thereon. The heating stove includes a return flue having a valve to control the amount of exhaust or combustion product gases returned to the combustion chamber where they are drawn through the grate and more completely combusted by the burning fuel.

Under the operating principles of the system described by Moldenhauer, et al., the exhaust gases recirculated to the combustion chamber burn freely and contribute to the heating effect of the stove, thereby accelerating ignition and increasing the rate of consumption of fuel materials supporting the primary burning process.

U.S. Pat. No. 4,242,972 of Sicard discloses a furnace including an elaborate combustion system which utilizes the basic exhaust gas recirculation technique disclosed by Moldenhauer, et al. The combustion system described by Sicard features an exhaust gas recirculation passageway having a particulate material storage container with means to agitate the particulate waste material to prevent excessive accumulation thereof. The suspended particles are pumped by a blower through the exhaust passageway to the combustion chamber and are burned therein. A damper included in the recirculation passageway controls the amount of exhaust gas returned to the combustion chamber.

Reduction of the amount of emitted pollutants is accomplished by recirculating hot combustion gases and a quantity of fresh air thereby to operate the furnace at a higher temperature to obtain more complete combustion. As in Moldenhauer, the principle of operation is to promote turbulence of the gases within the combustion chamber and accelerate ignition of both the combustion product gases and the combustible fuel material.

Other heating apparatus and stoves disclosing combustion systems which recirculate exhaust gases to increase the temperature and the burn rate within the combustion chamber include U.S. Pat. No. 602,962 of Sears, et al.; U.S. Pat. No. 664,751 of Hollingsworth; U.S. Pat. No. 2,603,195 of Permann; and U.S. Pat. No. 3,933,145 of Reich.

The second category of references includes patents disclosing the use of a catalytic converter or secondary burning chamber to combust more completely exhaust gases produced in a primary burning chamber.

U.S. Pat. No. 2,845,882 of Bratton discloses generally the use of catalytic units to reduce the number of pollutants emitted in the exhaust from an incinerator.

U.S. Pat. No. 4,319,556 of Schwartz, et al. discloses a wood-burning stove having a catalytic converter in which combustion product gases emitted from a primary combustion chamber are more completely combusted. The component parts of the stove include a combustion chamber, a catalytic converter, a heat exchanger, and a flue, all of which are functionally arranged in series relation in an open loop configuration. After the combustion product gases have been more completely combusted in the catalytic converter, the exhaust gases pass upwardly through the heat exchanger and outwardly of the system through the flue.

U.S. Pat. No. 4,330,503 of Allaire, et al. discloses a particular embodiment of a wood-burning stove having a catalytic converter interposed between a first outlet port of a combustion chamber and the inlet to a heat exchanger chamber. The outlet of the heat exchanger is structurally connected to both a flue and the combustion chamber through a three-channel passageway having a first control damper located at the outlet of the heat exchanger and a second control damper located at a second outlet port of the combustion chamber. The heat exchanger is in operational communication only with the flue; therefore, there is no recirculation of combustion product gases from the heat exchanger to the combustion chamber.

The operation of the two control dampers is coordinated to provide two separate, mutually exclusive open loop paths for the exhaust produced in the combustion chamber to pass through the flue direct into the atmosphere.

In the primary operational mode of the stove, the first control damper located at the inlet to the heat exchanger is opened to permit the combustion product gases to pass from the combustion chamber through the catalytic converter and heat exchanger to the flue and direct into the atmosphere. The second control damper located at the second inlet port to the combustion chamber remains in the fully closed position, thereby terminating a possible feedback path for the exhaust gases.

In a second operational mode, the first control damper is in the fully closed position and the second control damper is in an open position to eliminate back pressure within the stove to allow the exhaust gases to bypass the catalytic converter and heat exchanger and be discharged direct through the flue into the atmosphere during, for example, a fuel-loading operation. Again, recirculation of combustion product gases is neither contemplated nor operationally provided for.

Apparatus disclosing the use of a secondary combustion chamber performing the same operational function as the catalytic converter to combust more completely the exhaust gases include U.S. Pat. No. 4,180,052 of Henderson and U.S. Pat. No. 4,292,933 of Meier, et al.

None of the references discussed hereinabove discloses a heating apparatus utilizing both exhaust gas recirculation and a catalytic converter completely and efficiently to burn biomass fuel materials while maintaining elevated temperatures at reduced rates of combustion within the primary combustion chamber. A primary object of this invention, therefore, is to accomplish this task by providing an apparatus and a method which use a catalytic converter in combination with an exhaust gas recirculation passageway to eliminate the pollution content of the combustion product gases and return the residual exhaust gases to the combustion chamber to control the rate of combustion therein.

Another important object of this invention is to provide a heating apparatus and method which regulate the rate of combustion and consumption of fuel material by varying the quantity of recirculated combustion product residual gases returned to the combustion chamber.

A further important object of this invention is to provide a heating apparatus and method to recirculate conditioned exhaust gases back to the combustion chamber without automatically accelerating the ignition and increasing the consumption of fuel.

Still another important object of this invention is to provide a heating apparatus and method which produce and sustain elevated temperatures sufficient to support trouble-free operation of a catalytic converter without a requirement for accelerated rates of combustion and increased fuel consumption.

SUMMARY OF THE INVENTION

This invention overcomes the deficiencies presented in the prior art by providing an apparatus and a method for efficiently burning a substantially reduced quantity of biomass fuel material to produce a pollution-free source of heat.

The apparatus of the present invention is a heating mechanism comprised of a combustion chamber in which biomass fuel material, such as wood, held on a support means is ignited to produce a fire which generates thermal energy to be processed and distributed as desired. A fresh air inlet to the combustion chamber provides a source of oxygen to sustain burning of the fuel therein. Combustion product gases including volatile hydrocarbon pollutants and carbon dioxide are produced during burning of the fuel material in the combustion chamber. A heat exchanging means in communication with the combustion chamber converts for use the heat produced in the combustion chamber. A catalytic converter is disposed in association with a passageway originating from and terminating in the combustion chamber, which catalytic converter more completely combusts and modifies the content of the combustion product gases substantially to eliminate hydrocarbon pollutants contained within the combustion product gases and to produce residual exhaust gases including a substantial quantity of carbon dioxide gas for delivery through the passageway into the combustion chamber. A flow control means in communication with the combustion chamber varies the relative proportions of fresh air and carbon dioxide gas introduced into the combustion chamber to control the rate of combustion and to sustain a high temperature therein. The remaining portion of the residual exhaust gases is discharged through a flue.

The method of the present invention for accomplishing efficient combustion in a heating apparatus of a type described hereinabove includes the steps of igniting combustible fuel material, preferably wood or other biomass material, in a well-insulated combustion chamber to produce combustion product gases including volatile hydrocarbon pollutants and carbon dioxide at elevated temperatures. The combustion product gases are directed through a catalytic converter to promote complete combustion thereof substantially to eliminate the hydrocarbon pollutants and thereby produce hot residual exhaust gases including carbon dioxide. The hot exhaust gases are passed through a heat exchanging means and a control means which is adjusted selectably to vary the relative quantities of fresh air admitted through a fresh air inlet and of residual exhaust gases to form a gaseous mixture having a controlled proportion of carbon dioxide gas. The gaseous mixture including carbon dioxide gas is introduced into the combustion chamber to regulate the rate of combustion, and thereby the rate of fuel consumption, without materially affecting the temperature inside the combustion chamber. The remaining portion of carbon dioxide gas is discharged through a flue into the atmosphere.

The references reviewed hereinabove disclose heating systems which burn biomass fuel materials as the primary source of heat energy. The techniques practiced to enhance efficient combustion include either exhaust gas recirculation, which intensifies the heat generated within the combustion chamber and thereby increases the rate of consumption of fuel material, or the use of a catalytic converter in an open loop configuration to combust more completely the exhaust gases before emission into the atmosphere.

The present invention discloses an apparatus and a method efficiently to produce heat energy by combining an exhaust gas recirculation technique and the use of a catalytic converter to burn substantially completely the combustion product gases produced in the combustion chamber and recirculate the residual exhaust gases, comprised primarily of carbon dioxide gas, back to the combustion chamber to control the burn rate of fuel material therein. The effect of the inventive apparatus and method is that the catalytic converter functions at a very low combustion rate. Thus, the catalytic converter maintains high burning efficiency while the recirculation of carbon dioxide gas reduces the rate of combustion of the fuel material.

In a preferred embodiment of the invention, a heat exchanger is included within an exhaust gas recirculation passageway and is operatively connected to the discharge end of the catalytic converter to extract for use the heat carried by the residual exhaust gases.

Controlling the quantity of carbon dioxide gas introduced into the combustion chamber regulates the rate of combustion. Such is accomplished by a damper positioned in the passageway so as to vary the quantity of carbon dioxide gas flowing into the combustion chamber prior to mixture with fresh air admitted into the passageway through the fresh air inlet. Thus, the damper changes the composition of the gaseous mixture introduced into the combustion chamber by varying the relative proportion of carbon dioxide gas. The temperature of the carbon dioxide gas is high as compared with that of the admitted fresh air. In a preferred embodiment of the invention, the fresh air is preheated before it is mixed with the carbon dioxide gas. A large proportion of hot carbon dioxide gas introduced into a well-insulated combustion chamber maintains the high temperature environment therein while reducing the rate of combustion and fuel material consumption.

Although the apparatus of the present invention includes components used in the references discussed hereinabove, the overall arrangement and the operational theory of the present invention differs substantially from a mere combination of functions described.

Specifically, contrary to the teachings of the first category of references including Moldenhauer, et al. and Sicard, which utilize exhaust gas recirculation to promote complete burning of the unburned combustion product gases by increasing the rate of combustion and the temperature within the combustion chamber, the present invention makes use of an exhaust gas recirculation technique in combination with a catalytic converter and an insulated combustion chamber to provide a control means to minimize the intensity of burn while maximizing the heat retained in the combustion chamber.

The second category of references including Schwartz, et al. and Allaire, et al. discloses the use of a catalytic converter to eliminate the pollutants by performing a secondary combustion operation before discharging the exhaust direct into the atmosphere. In each case, the catalytic converter is included in an open loop exhaust conditioning system, thereby necessitating a high rate of combustion to produce and sustain the intense heat required for successful operation of the catalytic converter. The catalytic converter must operate at high temperatures to prevent the buildup of creosote. In the present invention, the catalytic converter can operate at a low rate of combustion. It functions to combust more completely the pollutants to produce carbon dioxide gas which is then recirculated into the combustion chamber to control the rate of burn and thereby the rate of consumption of fuel.

A damper is included in the recirculation passageway of the present invention to regulate the proportion of carbon dioxide gas introduced into the combustion chamber to control the rate of burn in the combustion chamber. A blower interposed between the damper and the outlet of the heat exchanger propels the carbon dioxide gas into the combustion chamber to produce sufficient turbulence therein to accomplish a uniform gaseous mixture of fresh air and carbon dioxide.

The method practiced heretofore of regulating the amount of fresh air to control the rate of burn reduces substantially the turbulence necessary to promote efficient combustion within the combustion chamber. Similarly, the admission of greater quantities of fresh air to increase the burn rate increases the turbulence and temperature within the combustion chamber. A catalytic converter can be operated successfully, but only at the expense of increased fuel consumption.

On the contrary, in the present invention, a well-insulated combustion chamber using carbon dioxide gas as a means to control the rate of burn preserves a uniform distribution of high temperatures within the stove and simultaneously reduces substantially the fuel consumption requirements to sustain proper operation of the catalytic converter.

The present invention, therefore, produces a totally unexpected effect. Exhaust gas recirculation and a catalytic converter when used separately in combustion systems normally require the introduction of sufficient quantities of fresh air to achieve an increased burn rate successfully to reburn and eliminate volatile hydrocarbon pollutants. The present invention, however, minimizes fresh air requirements while achieving complete combustion of solid and gaseous fuel materials. High efficiency is accomplished by extraction of heat through a heat exchanger; yet burn rate control through the use of carbon dioxide gas reduces the rate of combustion while elevated temperatures are maintained within the combustion chamber. Under steady state conditions, only the unused carbon dioxide gas is discharged through the flue into the atmosphere.

Additional objects and advantages of the present invention will become more apparent from the following detailed description of a preferred embodiment thereof which proceeds with reference to the accompanying drawings.

DETAILED DESCRIPTION OF PREFERRED EMBODIMENT

General Description

Figure 6:
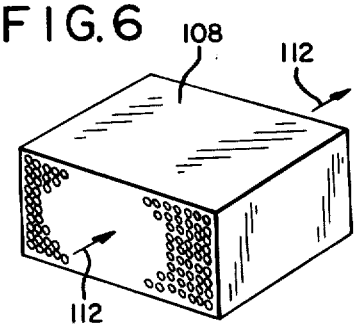
FIG. 6 is an isometric view of a catalytic converter utilized in the present invention.
Figure 1:
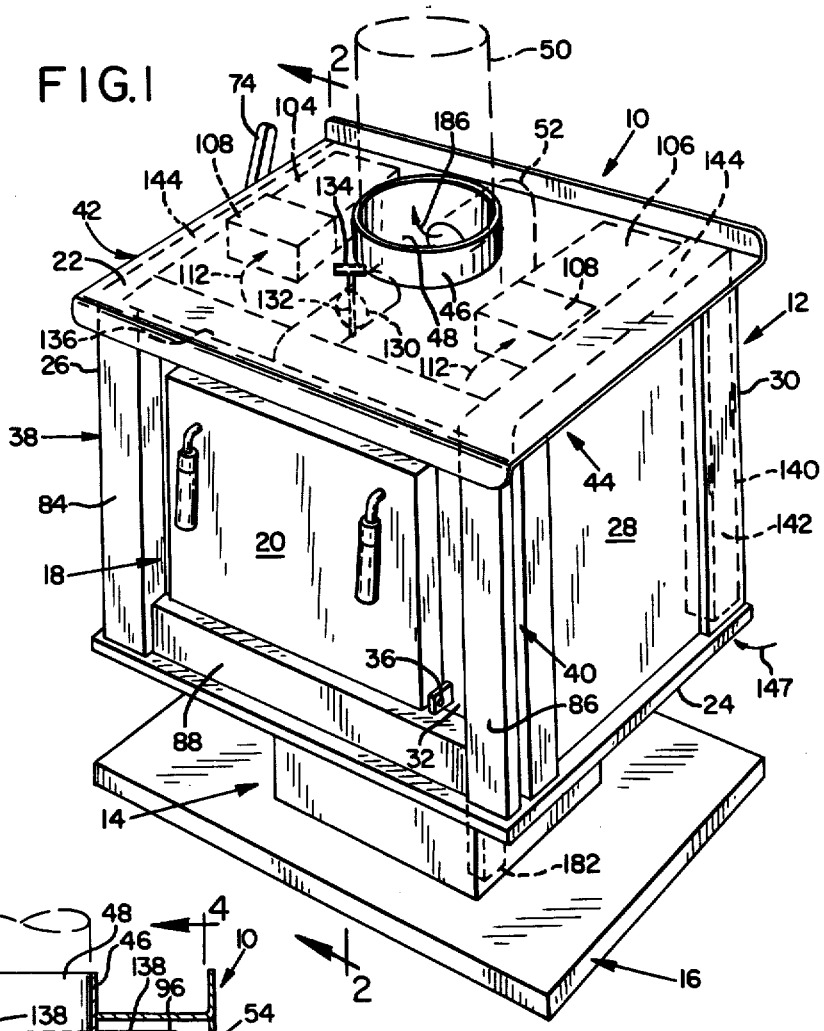
FIG. 1 is an upper, frontal perspective view of a wood stove showing in phantom portions of the apparatus of the present invention.

With reference to FIG. 1, an apparatus for effecting efficient combustion of biomass fuel materials in accordance with the invention is incorporated by way of example in a stove which is illustrated and designated generally by reference numeral 10. Stove 10 includes a stove body 12 which is mounted on the upper end of pedestal 14. The lower end of pedestal 14 is supported on laterally extending platform 16. Body 12 has rectangular frontal opening 18 and door 20 for closure of the opening. The outer surface of body 12 comprises top wall 22, bottom wall 24, side walls 26 and 28, rear wall 30, and front wall 32. Front wall 32 also comprises the front wall portion of combustion chamber 34 (FIG. 2), which is contained within body 12. Thus, body 12 forms a jacket around five sides of combustion chamber 34 to produce a cooler outer surface for the stove.

Door 20 is connected to front wall 32 of body 12 by means of hinges 36 to provide access to combustion chamber 34 for loading biomass fuel materials, such as wood, therein.

Vertical hot air outlet openings 38 and 40 extend along the frontal margins of side walls 26 and 28, respectively. Horizontal hot air outlet openings 42 and 44 extend along the upper margins of side walls 26 and 28, respectively.

Cylindrical collar 46 extends upwardly of circular opening 48 in top wall 22 to receive the lower end of flue 50 for discharging smoke from the combustion chamber and residual exhaust gases produced in accordance with the method of the invention. As will be further hereinafter described, flue 50 is in communication with combustion chamber 34 and discharge pipe 52, which conveys the residual exhaust gases drawn from heat exchanger 54 (FIGS. 2–5).

Stove Construction

Figure 2:
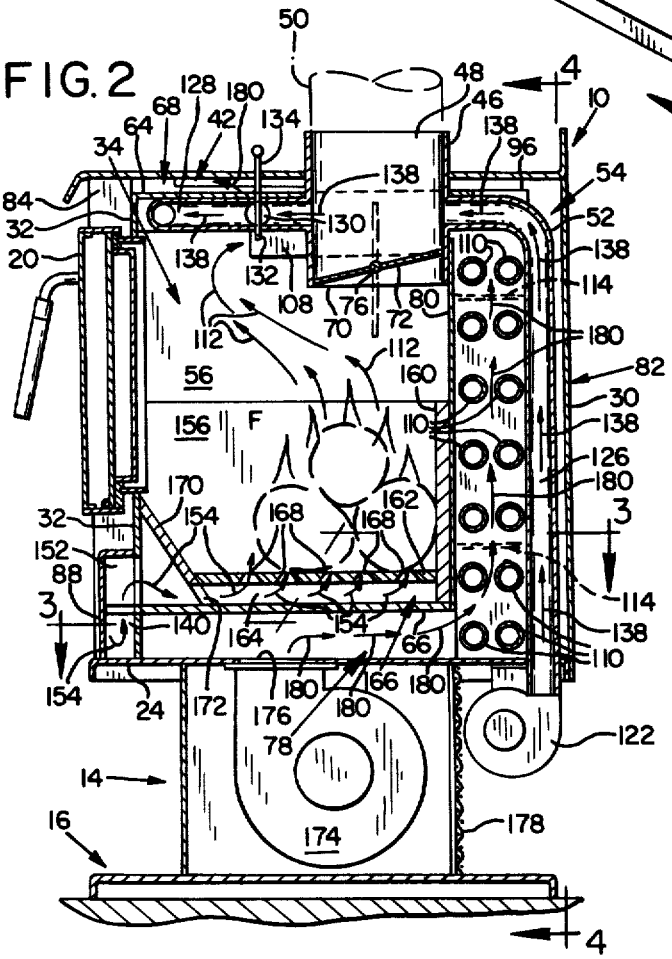
FIG. 2 is a vertical sectional view taken along line 2—2 of FIG. 1.
Figure 4:
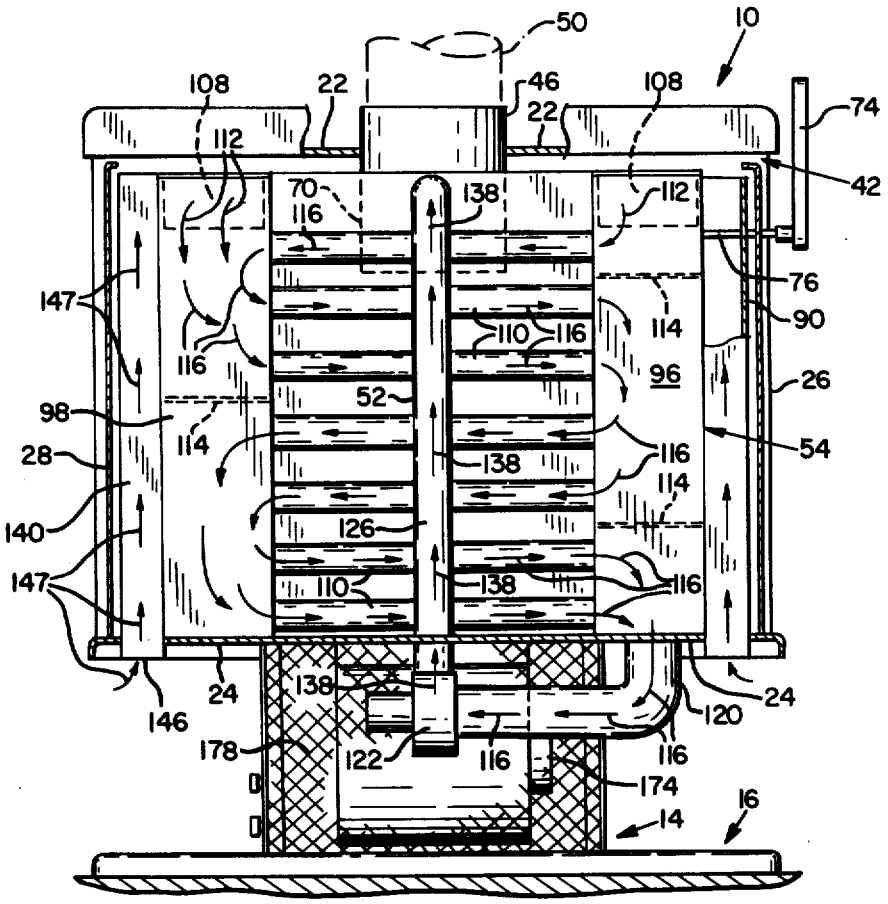
FIG. 4 is a vertical sectional view, with portions broken away, taken along line 4—4 of FIG. 2.
Figure 3:
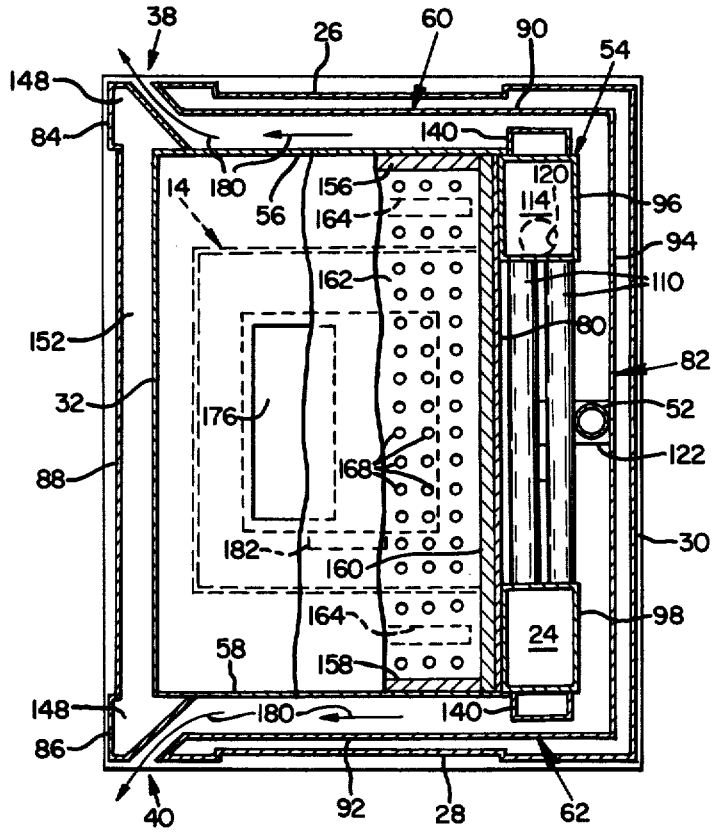
FIG. 3 is a horizontal sectional view taken along line 3—3 of FIG. 2.
Figure 5:
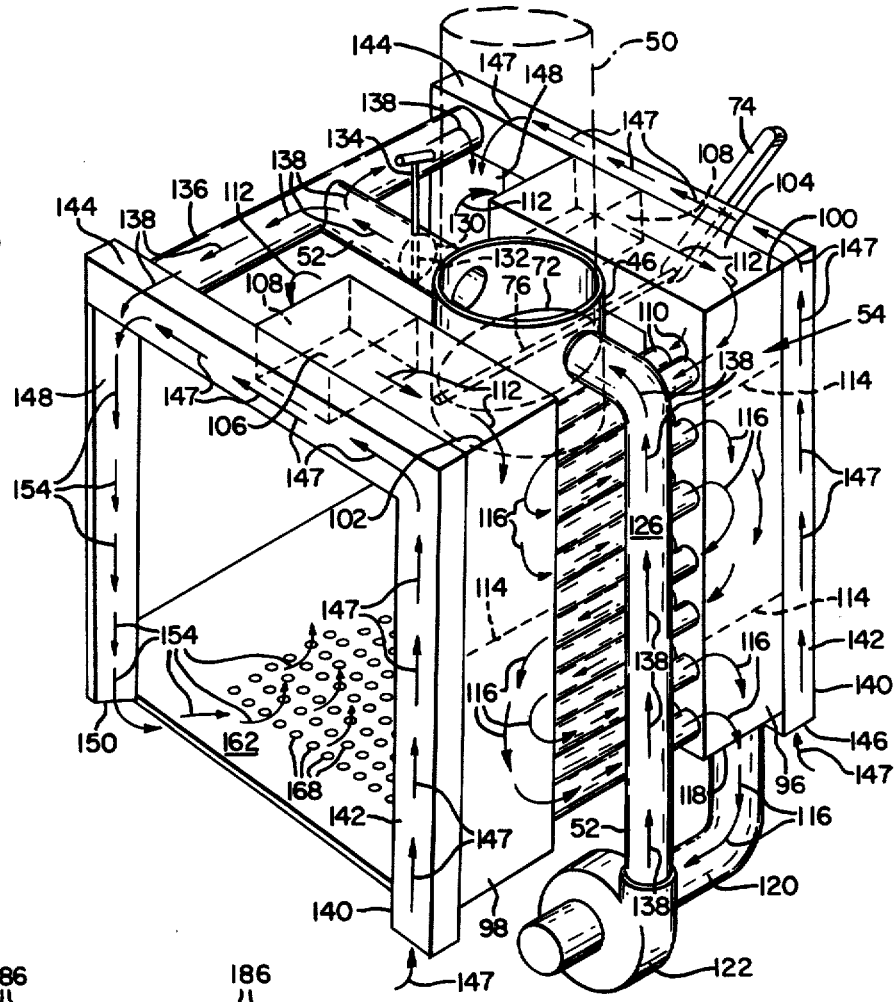
FIG. 5 is a rearward perspective view of the interior of the combustion chamber and the associated combustion rate control and heat exchanger apparatus of the present invention.

With reference to FIGS. 2–4, stove 10 includes combustion chamber 34 which is spaced inwardly from five of six wall portions and is contained within all of the wall portions that form the outer surface of body 12 to define a surrounding air space therebetween.

Combustion chamber 34 has parallel opposite side walls 56 and 58 which extend vertically from bottom wall 24 to support the combustion chamber thereon. Combustion chamber side walls 56 and 58 are parallel to and spaced inwardly of stove body side walls 26 and 28, respectively, to define side air space portions 60 and 62.

Combustion chamber 34 also has upper wall 64 and lower wall 66. Upper wall 64 extends horizontally between the upper edges of walls 56 and 58 and is spaced downwardly from stove body top wall 22 to define upper air space portion 68. Inner flue collar 70 has the same radius as and is axially aligned with collar 46 to form a continuation of circular flue opening 48 into combustion chamber 34.

Damper 72 is a circular disk-like element that is included within collar 70 and is operatively connected to lever 74 for movement about pivot axis 76 located beneath the plane of upper wall 64 of the combustion chamber. The radius of damper 72 is equal to the inner radius of collar 70 to provide a tight seal for closing the passageway from combustion chamber 34 to flue 50 and discharge pipe 52 during normal stove operation. Damper 72 is opened to reduce the back pressure within the combustion chamber to prevent smoke from being discharged through fuel loading door 20 during a fuel loading operation.

Lower wall 66 extends horizontally between side walls 56 and 58 at a position spaced above bottom wall 24 to define lower air space portion 78.

Combustion chamber 34 also has rear wall 80 extending from side-to-side between the rearward edges of side walls 56 and 58 and extending vertically between the rearward edges of upper wall 64 and lower wall 66. Rear wall 80 is spaced inwardly from stove body rear wall 30 to define rear air space portion 82.

As was described hereinabove, combustion chamber front wall 32 extends vertically between top wall 22 and bottom wall 24 of stove body 12. The frontal edges of combustion chamber side walls 56 and 58 are joined with front wall 32 at a position intermediate the vertical ends thereof. Unlike the other walls of combustion chamber 34, front wall 32 is not fully jacketed. However, door 20 may be constructed to form an effective jacket over the central portion of wall 32. In addition, front wall 32 is recessed from frontal extensions 84 and 86 of stove body side walls 26 and 28, respectively, and from combustion air manifold wall 88 which extends horizontally along the lower margin of wall 32.

An intermediate heat baffle is spaced a short distance inwardly of side walls 26 and 28 and rear wall 30 of body 12 to subdivide into inner and outer sections the side air space portions 60 and 62 and rear air space portion 82. The baffle includes vertical side portions 90 and 92 extending rearwardly from vertical air outlet openings 38 and 40, respectively, and vertical rear portion 94 extending from side-to-side between the rearward edges of side portions 90 and 92. The upper edge of the baffle is spaced a short distance below stove body top wall 22, and the lower edge of the baffle is spaced above bottom wall 24 to permit air to flow into both the inner and outer sections of the air spaces. The inner surface of the heat baffle is covered with heat-reflective material to contain most of the heat within the inner air space section.

Heat Exchanger and Combustion Rate Control Apparatus

With reference to FIGS. 2–5, the heat exchanging means includes heat exchanger 54, which is positioned adjacent and spans the outer surface of rear wall 80 of combustion chamber 34. Heat exchanger 54 comprises two tubular channels 96 and 98 extending along the vertical edges of rear wall 80. Inlets 100 and 102 to the heat exchanger are formed by an opening located in the upper end of each channel 96 and 98, respectively. Inlets 100 and 102 receive the heat produced in combustion chamber 34 by means of conduits 104 and 106, respectively, which extend through openings near the top of combustion chamber rear wall 80.

Located inside combustion chamber 34 and included within each conduit 104 and 106 is one of two catalytic converters 108 which receive the combustion product gases to combust more fully the pollutants contained therein. Residual exhaust gases including carbon dioxide are emitted from the catalytic converters.

A series of horizontally disposed cylindrical pipes 110 extend between the opposed inner sides of channels 96 and 98 to interconnect the channels. Pipes 110 are stacked vertically between the channels in a ladder configuration behind rear wall 80 of the combustion chamber. Preferably, two such sets of pipes disposed parallel to the surface of rear wall 80 extend between channels 96 and 98. The direction of heat flow from the combustion chamber to the inlet of the heat exchanger is indicated by arrows 112.

Internal divisions 114 within channels 96 and 98 direct the flow of heat in a sinuous path through the heat exchanger pipes 110 as indicated by arrows 116. As shown, a single outlet 118 provided at the bottom end of channel 96 of heat exchanger 54 is connected by pipe section 120 to the low pressure inlet of recirculation blower 122. Blower 122 provides the amount of suction required to draw the residual exhaust gases through heat exchanger 54 for delivery back to combustion chamber 34 to control the rate of combustion as will be hereinafter further described. Blower 122 increases the flow rate of the gases exiting and entering combustion chamber 34 to produce sufficient turbulence to provide a nearly uniform gaseous mixture within the combustion chamber.

The residual exhaust gases are directed from blower 122 through discharge pipe 52. Discharge pipe 52 intersects collar 70 which comprises an extension of flue 50, to divide the pipe into two portions 126 and 128 with an open space therebetween. Discharge pipe 52 intersects collar 70 at a point located above pivot axis 76 of damper 72 so that pipe 52 is not in communication with combustion chamber 34 during normal stove operation. The ends of pipe 52 that open into flue 50 fit into axially aligned apertures in collar 70 which provide a straight-line path for the residual exhaust gases flowing therethrough.

Included within portion 128 is damper 130 which constitutes a flow control means to regulate the amount of residual exhaust gases to be delivered to combustion chamber 34. Damper 130 is of the type similar to damper 72 and is moved about its pivot axis 132 by means of adjustment rod 134 to vary the extent of occlusion of pipe portion 128. Adjusting the position of damper 130 determines the amount of residual exhaust gases received by portion 128 with the remaining amount being discharged into flue 50. The residual exhaust gases are propelled by blower 122 under pressure sufficient to deliver a substantial quantity of the gases flowing from pipe portion 126 through the open space in flue 50 to pipe portion 128 whenever the surface of damper 130 is aligned with the longitudinal axis of pipe portion 128.

Pipe portion 128 is joined generally near the center part of pipe section 136, which extends horizontally inside combustion chamber 34 along the top frontal portion thereof. Arrows 138 indicate the path of travel of the residual exhaust gases which issue from the outlet of blower 122 and flow to the ends of pipe section 136.

Each end of pipe section 136 extends through a side wall of the combustion chamber and is joined at the frontal corner of one of two fresh air inlets 140, which comprise inverted L-shaped conduits having vertical segments 142 and horizontal segments 144 that extend along the rear side and top side edges, respectively, of combustion chamber 34. The rear vertical segment 142 of each inlet 140 is adjacent the outer edge of one of the tubular channels of heat exchanger 54 to preheat the fresh air admitted through inlet apertures 146. Arrows 147 indicate the path of fresh air flowing into and through inlets 140. The preheated fresh air is mixed with the controlled quantity of residual exhaust gases at the junctions of pipe section 136 and horizontal segments 144 and is then directed into conduits 148, which comprise frontal extensions 84 and 86 and extend below the plane of bottom wall 66 of combustion chamber 34. The gaseous mixture is discharged through apertures 150 of conduits 148 into either end of combustion air manifold 152. Manifold 152 extends horizontally along the bottom frontal portion of the stove and has an opening which extends along the entire length of the upper portion of the manifold so that the gaseous mixture can flow into combustion chamber 34. Arrows 154 indicate the path of the gaseous mixture flowing through conduits 140 and into combustion chamber 34.

With reference to FIGS. 2 and 3, the inside of combustion chamber 34 is a cast iron refractory with vertical side walls 156 and 158 and vertical rear wall 160 supported on bottom wall 66 and extending upwardly approximately one-half the distance to top wall 64. These walls are comprised of a double layer of fiber frax material which shields the sheet metal combustion chamber walls from direct contact with the flames and hot coals produced by fire F and thereby provides insulation for the combustion chamber to contain the heat generated therein.

Grate 162 is supported above bottom wall 66 by legs 164 to provide air space 166 beneath the grate. A plurality of inverted conical openings 168 extend through the grate to admit the mixture of fresh air and residual exhaust gases into the combustion chamber.

Inclined front wall 170 extends across the front of combustion chamber 34 between the frontal edge of grate 162 and front wall 32. Front wall 170 leans diagonally against front wall 32 at a position just below door 20 and is supported on bottom wall 66 by integral legs 172 to provide a path for the gaseous mixture to reach the combustion chamber. The space beneath inclined wall 170 defines a plenum into which the gaseous mixture flows from manifold 152 to be further warmed before passing through air space 166 beneath the grate into combustion chamber 34 to control the rate of combustion therein.

Thus, the apparatus described hereinabove comprises a passageway that originates at the top of combustion chamber 34 with conduits 104 and 106 receiving combustion product gases and terminates at the bottom of combustion chamber 34 with conduits 148 delivering a gaseous mixture of fresh air and residual exhaust gases through manifold 152.

With reference to FIGS. 2–4, heat exchanger blower 174 is housed within the central portion of pedestal 14 and is connected to rectangular opening 176 located generally centrally on the surface of bottom wall 24. Blower 174 draws air at ambient temperatures from outside the stove through perforated rear wall 178 of the pedestal. As indicated by arrows 180, air is discharged into lower air space portion 78 and is directed through air space portion 82 which includes heat exchanger 54. The air passing through the area proximate heat exchanger 54 is raised to temperatures of approximately 200°–250° F. and is directed outside the stove through vertical hot air openings 38 and 40 and horizontal openings 42 and 44 (FIG. 1). Blower speed control 182 is electrically connected to blower 174 to energize the blower and vary its speed. The blower speed affects the rate of delivery of hot air to the area outside the stove.

In the preferred embodiment of the inventive apparatus, heat is produced at 80 percent efficiency, which is approximately twice that of currently available heating devices.

It will be appreciated that in an alternative embodiment, flue 50 may comprise the heat exchanging means, and heat exchanger 54 could be eliminated from the passageway. In this configuration, a substantial portion of the residual exhaust gases is directed to flue 50, which would radiate the heat transferred thereto. The remaining portion of the gases is used to control the burn rate of the fuel contained within the combustion chamber.

Method of Operation

Figure 7:
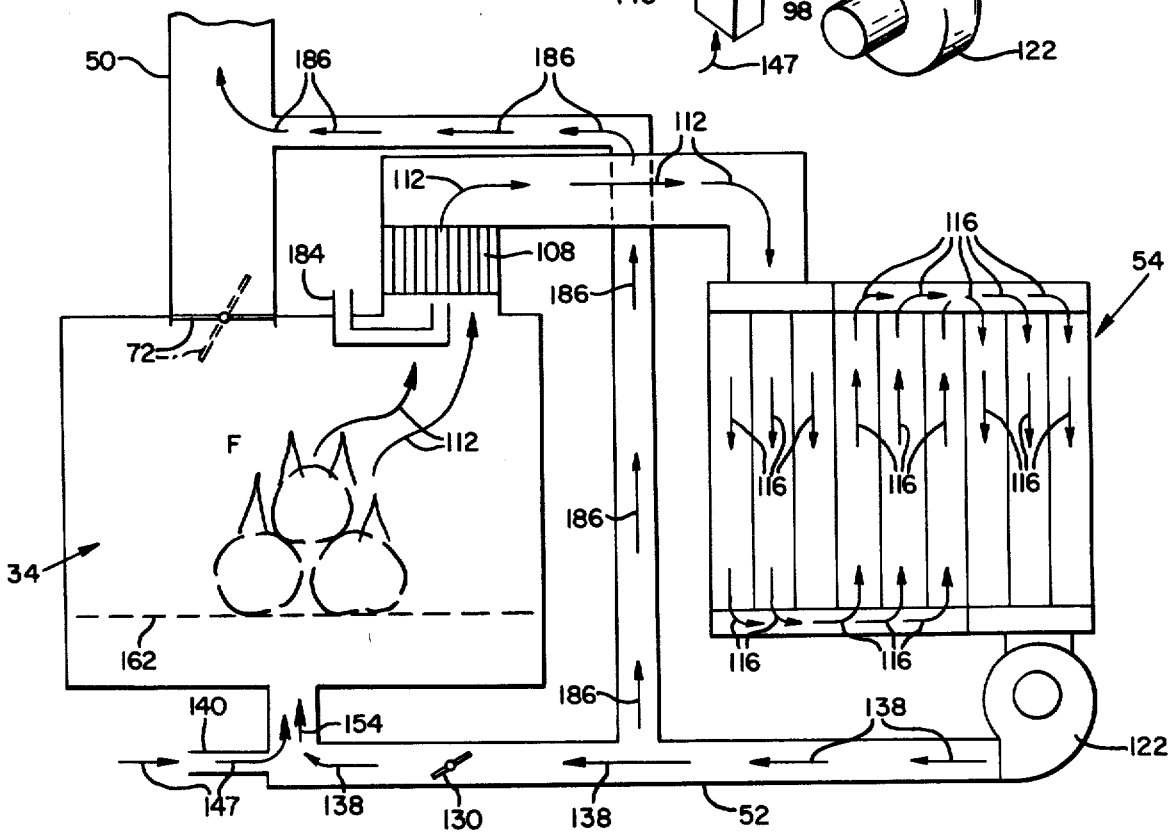
FIG. 7 is a system diagram showing the flow of combustion product and residual exhaust gases processed in accordance with the method of the present invention.

With reference to FIG. 7, in accordance with the preferred method, fire F resulting from igniting wood or other combustible material in a well-insulated combustion chamber 34 produces combustion product gases which include unburned, volatile hydrocarbon pollutants and carbon dioxide. Damper 72 is kept in a horizontal disposition to eliminate a direct passageway for the combustion product gases from combustion chamber 34 to flue 50 during normal operation of the stove.

The combustion product gases are then directed through catalytic converter 108 which serves to concentrate the heat generated in the combustion chamber to complete combustion of the unburned hydrocarbon gases leaving the combustion chamber. The combustion process in the catalytic converter can be enhanced by means of secondary combustion air inlet 184, which introduces additional fresh air to the catalytic converter. The residual exhaust gases leaving catalytic converter 108 are comprised substantially of carbon dioxide at temperatures exceeding 1500° F.

The residual exhaust gases are then introduced into heat exchanger 54 from which the heat carried by the gases is extracted and processed by passing ambient air around the outer surface of the heat exchanger.

The residual exhaust gases, which are cooled to about 350° F. are drawn from heat exchanger 54 by blower 122, which drives the combustion system by increasing the gas flow rate through the passageway originating from and terminating in the combustion chamber to enhance turbulence within the combustion chamber.

The amount of residual exhaust gases introduced into combustion chamber 34 is varied by flow control damper 130. Prior to introduction into combustion chamber 34, the carbon dioxide gas is mixed with air drawn from fresh air inlet 140, which has an orifice of fixed size. To regulate the rate of combustion within combustion chamber 34, damper 130 is adjusted to change the effective opening in discharge pipe 52 to vary the relative amounts of carbon dioxide gas and fresh air admitted into the combustion chamber. A higher ratio of carbon dioxide gas in the mixture reduces the rate of combustion. The quantity of residual exhaust gases excluded from combustion chamber 34 by damper 130 is discharged through flue 50 as indicated by arrows 186.

Although preferred embodiments of the inventive apparatus and process have been described in detail, it is to be understood that various changes, substitutions, and alterations can be made therewith without departing from the spirit and scope of the invention as defined in the appended claims.

What is claimed is:

1. A heating apparatus comprising:

a combustion chamber having a fresh air inlet and a grate to support biomas fuel material thereon;

a passageway having a first end portion originating generally near the top and a second end portion terminating generally near the bottom of the combustion chamber;

the first end portion comprising two conduits with the inlet ends thereof in communication with two openings in the combustion chambr and the outlet ends thereof in communication with inputs to a het exchanger, each conduit including a catalytic converter positioned to receive hot combustion product gases produced in the combustion chamber for transformation to substantially pollutant-free residual exhaust gases that are delivered to the heat exchanger to convert for use the heat carried thereby, and the second end portion comprising an opening in communication with a flue and a flow control means in communication with the outlet of the heat exchanger to vary the quantity of substantially pollutant-free residual exhaust gases introduced into the combustion chamber and to discharge the remaining quantity thereof through the flue.

2. The apparatus as in claim 1 wherein a blower is operatively connected to the passageway to promote circulation of the residual exhaust gases through the passageway to maintain the desired degree of turbluence within the combustion chamber.

3. The apparatus as in claim 1 wherein the fresh air inlet comprises an opening in the second end portion of the passageway and which opening admits fresh air that is combined with the controlled quantity of residual exhaust gases before introduction into the combustion chamber.

4. The apparatus as in claim 1 wherein the fresh air inlet is positioned adjacent the heat exchanger to provide a source of preheated fresh air.

5. The apparatus as in claim 1 wherein a section of the passageway between the outlet of the heat exchanger and the combustion chamber intersects the flue to form an opening therein.

* * * * *